US007048591B1

(12) United States Patent
Chiang

(10) Patent No.: US 7,048,591 B1
(45) Date of Patent: May 23, 2006

(54) TERMINAL-MOUNTING SEAT

(75) Inventor: Ching-Chung Chiang, Taichung Hsien (TW)

(73) Assignee: Excel Cell Electronic Co., Ltd. (TW)

( * ) Notice: Subject to any disclaimer, the term of this patent is extended or adjusted under 35 U.S.C. 154(b) by 0 days.

(21) Appl. No.: 11/046,725

(22) Filed: Feb. 1, 2005

(51) Int. Cl.
*H01R 9/22* (2006.01)

(52) U.S. Cl. ..... 439/709; 439/811

(58) Field of Classification Search ..... 439/709, 439/811, 814, 810, 812
See application file for complete search history.

(56) References Cited

U.S. PATENT DOCUMENTS 5,314,360 A * 5/1994 Jaag ..... 439/811
5,368,506 A * 11/1994 Heimbrock ..... 439/813
5,595,505 A * 1/1997 Duke et al. ..... 439/630
6,146,212 A * 11/2000 Kipnik ..... 439/709
6,238,234 B1 * 5/2001 Sedlecky ..... 439/412

* cited by examiner

*Primary Examiner*—Briggitte Hammond
*Assistant Examiner*—Phuongchi Nguyen
(74) *Attorney, Agent, or Firm*—Banner & Witcoff, Ltd.

(57) ABSTRACT

A terminal-mounting seat includes a conducting member mounted fixedly in a housing and having an elongate contacting end portion and a terminal-engaging end portion that is in electrical contact with a terminal and that is adjacent to a front open side of the housing. A mounting block is mounted movably in the housing, and has an insert hole permitting extension of the contacting end portion thereinto. A cover body is mounted on the front open side of the housing for concealing the conducting member and the mounting block within the housing, and has an insert groove permitting insertion of an electrical wire therethrough via the front open side. A fastening member is mounted rotatably in a through hole in the housing, engages a threaded hole in the mounting block, and is operable so as to move the mounting block to move upwardly within the housing.

6 Claims, 6 Drawing Sheets

TERMINAL-MOUNTING SEAT

BACKGROUND OF THE INVENTION

1. Field of the Invention

The invention relates to a terminal-mounting seat, more particularly to a terminal-mounting seat that can prevent electrical shock during use, and that can ensure electrical connection between a terminal and an electrical wire.

2. Description of the Related Art

Referring to FIG. 1, a conventional terminal-mounting seat 10 is shown to include a housing 11, a mounting block 12, a conducting member 13, and a fastening member 14. The housing 11 is configured with a receiving space 111, and has a front open side 112, and opposite top and bottom walls 113, 114. The top wall 113 is formed with a through hole 1131 in spatial communication with the receiving space 111. The bottom wall 114 is formed with a counterbore 1141 that is in spatial communication with the receiving space 111 and that permits extension of a terminal 100 therethrough. The conducting member 13 is mounted fixedly in the receiving space 111 in the housing 11, and has a terminal-engaging end portion 131 disposed distal from the front open side 112 and in electrical contact with the terminal 100, a bent contacting end portion 133 disposed adjacent to the front open side 112, and an elongate intermediate portion 132 interconnecting the terminal-engaging end portion 131 and the contacting end portion 133. The mounting block 12 is mounted in the receiving space 111 in the housing 11, and has a front surface 121 formed with an insert groove 1211 that permits insertion of an electrical wire 200 thereinto via the front open side 112 of the housing 11, and a top surface 122 formed with a threaded hole 1221 that is in spatial communication with the insert groove 1211. The intermediate portion 132 of the conducting member 13 is fixed between the top wall 113 of the housing 11 and the top surface 122 of the mounting block 12. The contacting end portion 133 of the conducting member 13 extends into the insert groove 1211. The fastening member 14 is mounted rotatably in the through hole 1131 in the housing 11, and extends into the receiving space 111 in the housing 11. The fastening member 14 has a thread rod portion 141 that engages the threaded hole 1221 in the top surface 122 of the mounting block 12. The fastening member 14 is operable so as to enable the thread rod portion 141 to extend into the insert groove 1211, thereby pressing the contacting end portion 133 of the conducting member 13 against an exposed end portion 201 of the electrical wire 200.

The following are some of the drawbacks of the conventional terminal-mounting seat 10:

1. Since the thread rod portion 141 presses against the contacting end portion 133 of the conducting member 13, the latter may deform and come to be positioned as shown by the imaginary lines. As a result, a portion of the bent contacting end portion 133 is disposed outwardly of the insert groove 1211 of the mounting block 121. Exposure of the contacting end portion 133 easily results in electrical shock as this increase, the likelihood that a user will inadvertently contact the same. Moreover, after a long period of use, permanent deformation of the contacting end portion 133 may adversely affect electrical contact between the contacting end portion 133 and the exposed end portion 201 of the electrical wire 200.

2. The electrical wire 200 is typically in the form of twisted individual wires (not shown). As such, pressing of the contacting end portion 133 may damage the exposed end portion 201 of the electrical wire 200 to thereby unravel and spread apart the twisted individual wires such that electrical contact between the contacting end portion 133 and the bared end portion 201 of the electrical wire 200 cannot be ensured.

SUMMARY OF THE INVENTION

Therefore, the object of the present invention is to provide a terminal-mounting seat that can eliminate the aforesaid drawbacks of the prior art.

According to the present invention, a terminal-mounting seat comprises:

- a housing configured with a receiving space and having a front open side and a rear side, the housing further having opposite top and bottomwalls, the top wall being formed with a through hole in spatial communication with the receiving space, the bottom wall being formed with a mounting hole that is in spatial communication with the receiving space and that is adapted to permit extension of a terminal therethrough;
- a conducting member mounted fixedly in the receiving space in the housing, the conducting member having an terminal-engaging end portion disposed adjacent to the rear side of the housing and adapted to be in electrical contact with the terminal, and an elongate contacting end portion connected to the terminal-engaging end portion and disposed adjacent to the front open side of the housing;
- a mounting block mounted movably in the receiving space in the housing, the mounting block having opposite front and rear surfaces, and a top surface, the mounting block being formed with an insert hole extending from the front surface to the rear surface, and a threaded hole that is formed in the top surface, that is in spatial communication with the insert hole, and that is aligned with the through hole in the housing, the insert hole permitting extension of the contacting end portion thereinto;
- a cover body mounted on the front open side of the housing such that the conducting member and the mounting block are concealed within the receiving space in the housing, the cover body being formed with an insert groove adapted to permit an electrical wire to be inserted into the receiving space therethrough; and
- a fastening member mounted rotatably in the through hole in the housing and extending into the receiving space in the housing, the fastening member having a thread rod portion that engages the threaded hole in the mounting block, the fastening member being operable so as to drive the mounting block to move upwardly within the housing, thereby pressing the electrical wire against the contacting end portion of the conducting member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
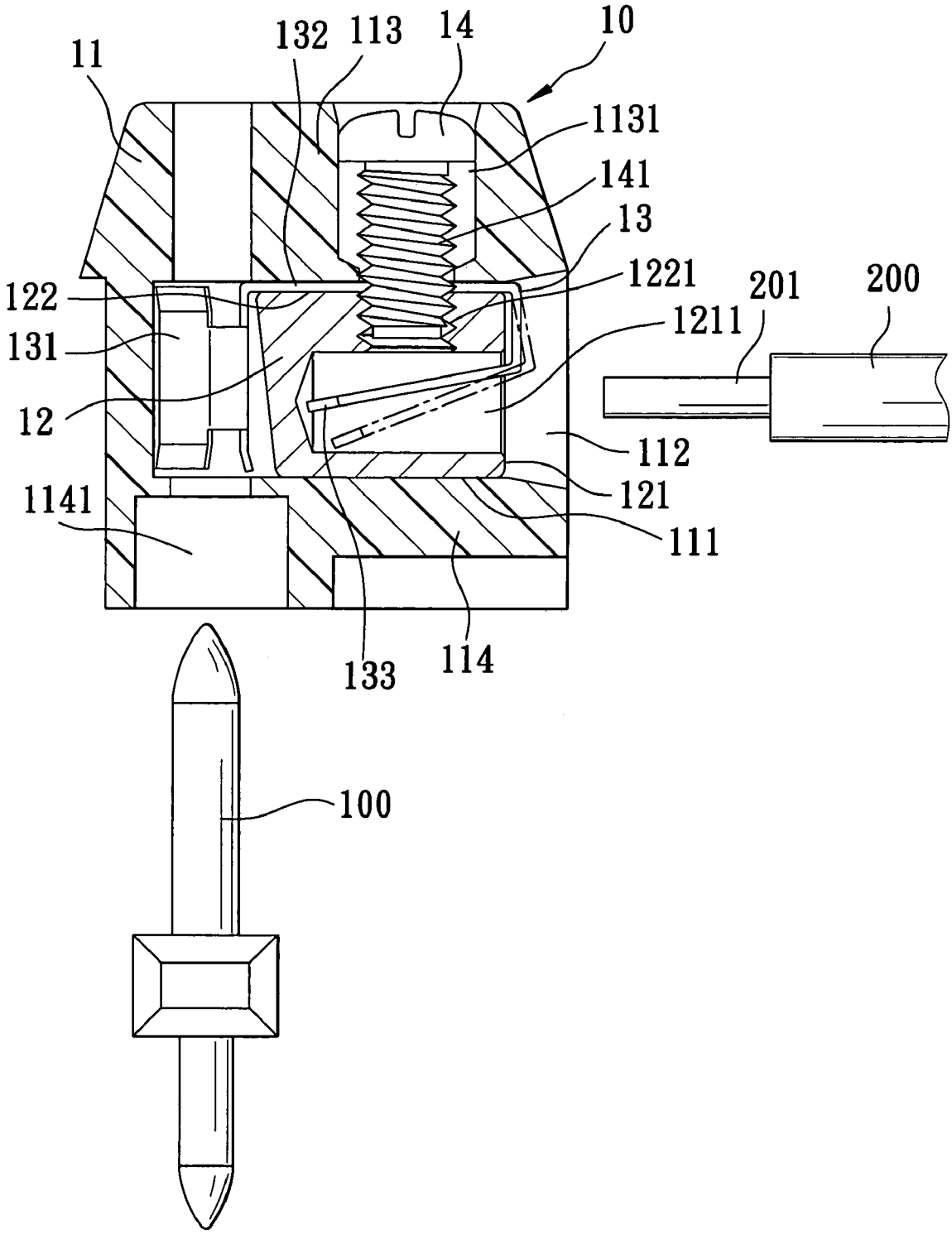
FIG. 1 PRIOR ART
FIG. 1 is a schematic sectional view of a conventional terminal-mounting seat.

Before the present invention is described in greater detail, it should be noted that like elements are denoted by the same reference numerals throughout the disclosure.

Figure 2:
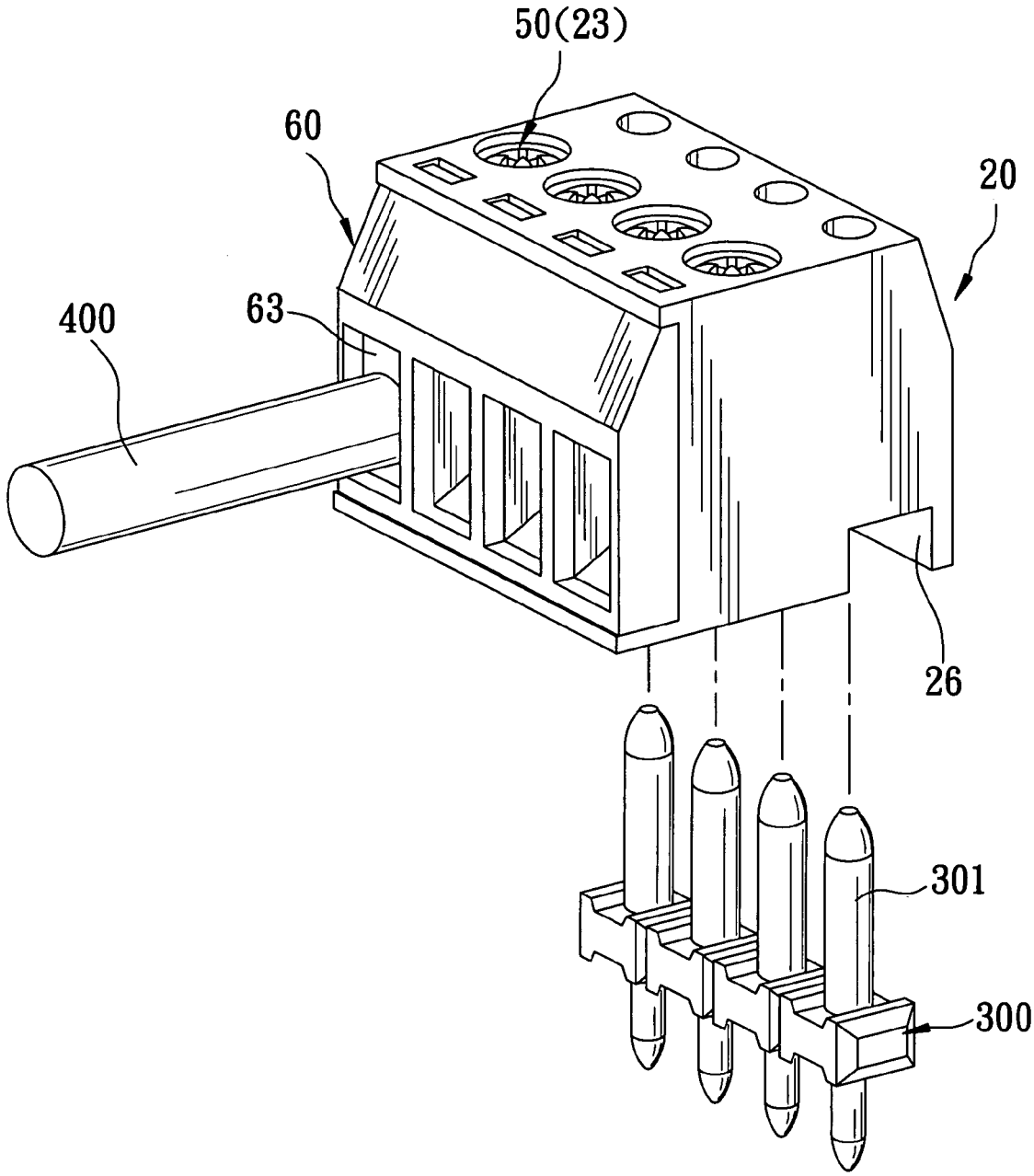
FIG. 2 is a perspective view showing the first preferred embodiment of a terminal-mounting seat assembled with an electrical wire and a terminal set according to the present invention.
Figure 3:
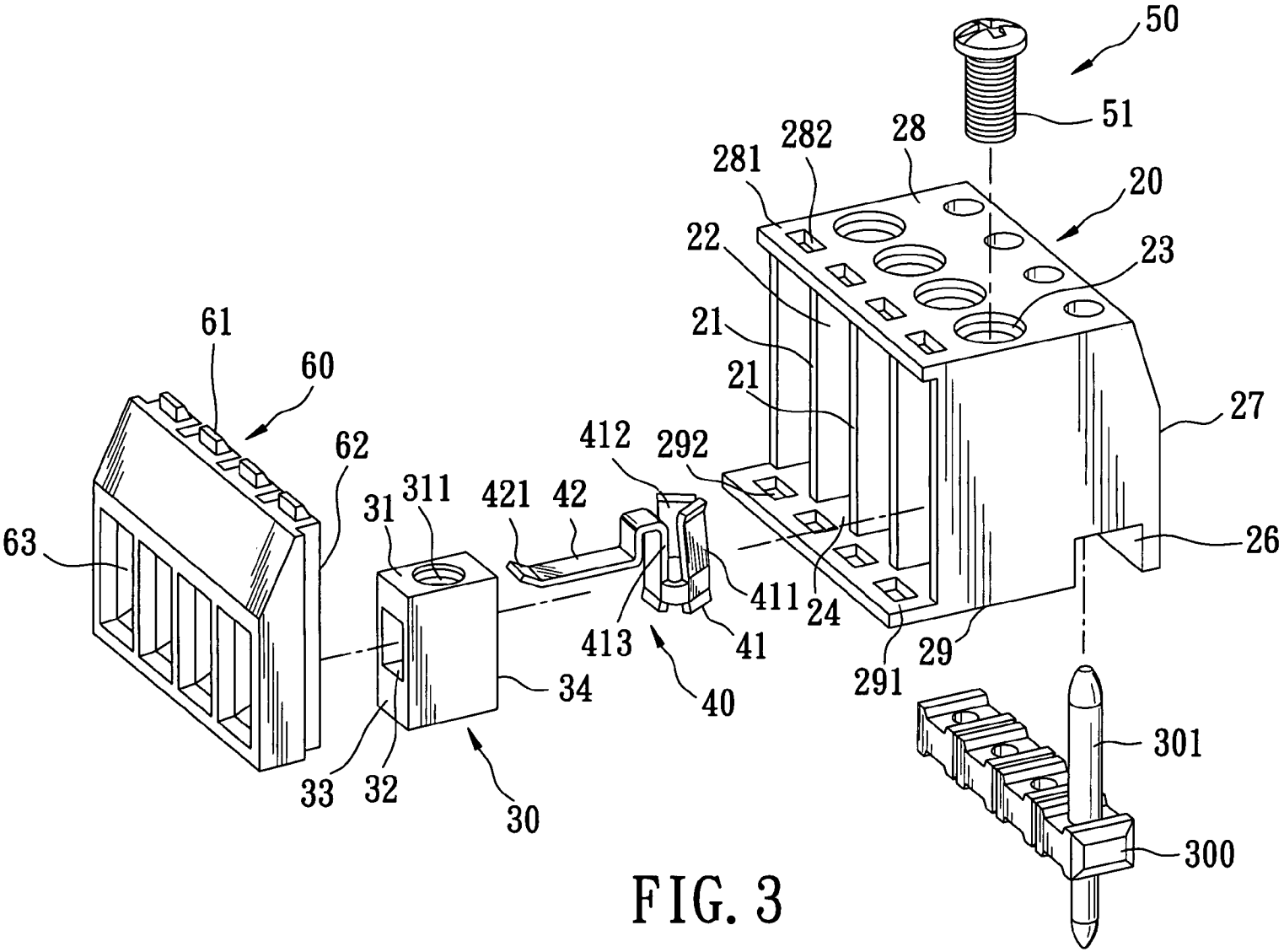
FIG. 3 is an exploded perspective view showing the first preferred embodiment.
Figure 4:
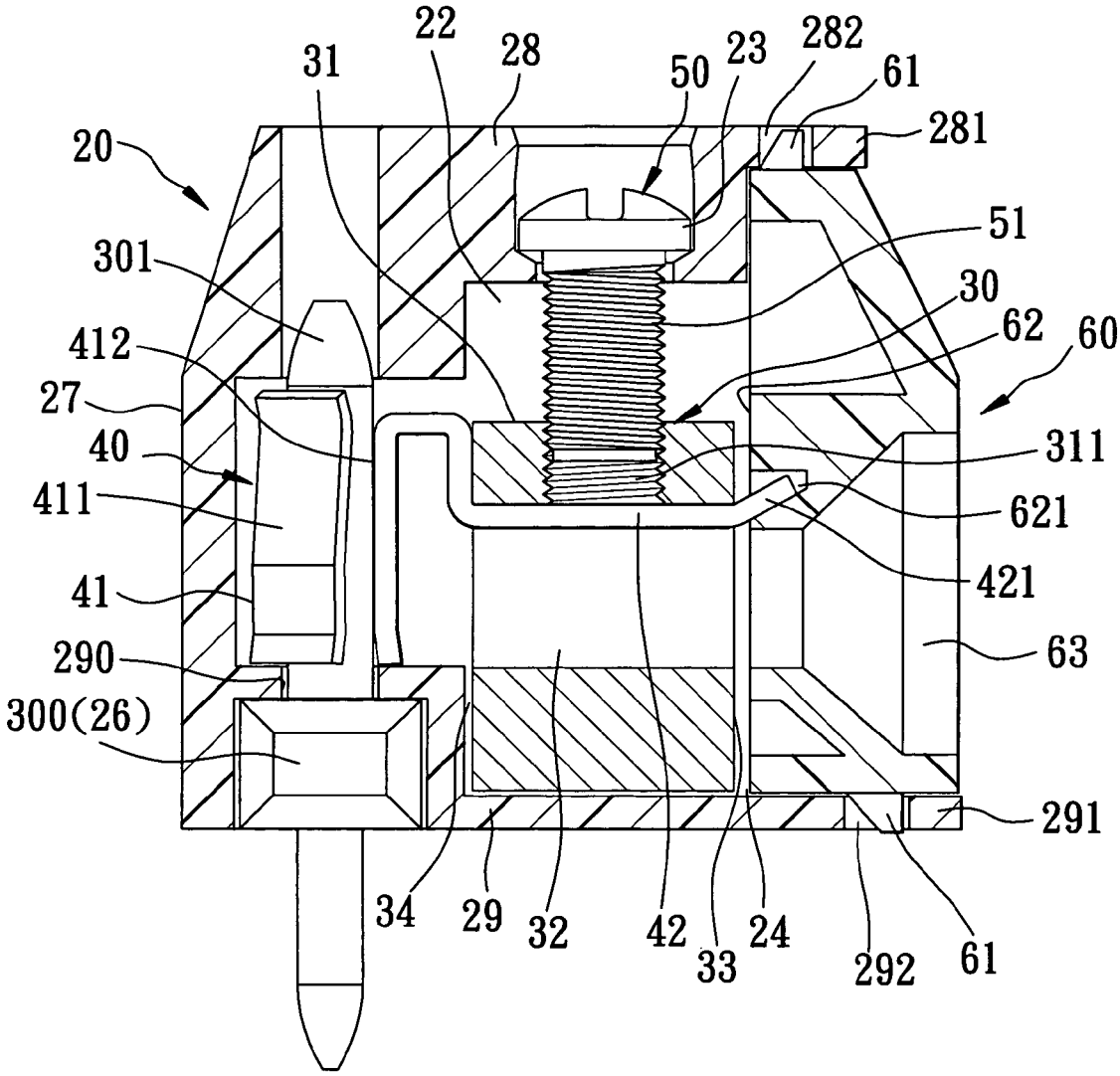
FIG. 4 is a schematic sectional view showing the first preferred embodiment.

Referring to FIGS. 2, 3 and 4, the preferred embodiment of a terminal-mounting seat according to the present invention is shown to include a housing 20, a plurality of conducting members 40, a plurality of mounting blocks 30, a cover body 60, and a plurality of fastening members 50. It is noted that only one conducting member 40, the corresponding mounting block 30 and the corresponding fastening member 50 are shown in FIG. 3.

The housing 20 has a front open side 24, a rear side 27, and opposite top and bottom walls 28, 29. In this embodiment, the housing 20 further has a plurality of parallel partition walls 21 disposed vertically and connected between the top and bottom walls 28, 29 such that the top and bottom walls 28, 29, and the partition walls 21 confine a plurality of receiving spaces 22. In this embodiment, the top wall 28 is formed with a plurality of through holes 23, each of which is in spatial communication with a corresponding one of the receiving spaces 22, as best shown in FIG. 4. The bottom wall 29 is formed with a plurality of mounting holes 290. Each mounting hole 290 is in spatial communication with a corresponding one of the receiving spaces 22, and is adapted to permit extension of a terminal 301 of a terminal set 300, which, in turn, is adapted to be mounted in a mounting groove 26 in the bottom wall 29, as best shown in FIG. 4.

In FIGS. 3 and 4, the conducting member 40 is mounted fixedly in the corresponding receiving space 22 in the housing 20. The conducting member 40 has a terminal-engaging end portion 41 disposed adjacent to the rear side 27 of the housing 20 and adapted to be in electrical contact with the terminal 301, as shown in FIG. 4, and an elongate contacting end portion 42 connected to the terminal-engaging end portion 41 and disposed adjacent to the front open side 24 of the housing 20. In this embodiment, the terminal-engaging end portion 41 is formed with a clamping unit that is adapted to clamp the terminal 301 and that includes three clamp arms 411, 412, 413, as shown in FIG. 3. In this embodiment, the contacting end portion 42 has a bent distal end 421.

In FIGS. 3 and 4, the mounting block 30 is mounted movably in the corresponding receiving space 22 in the housing 20. The mounting block 30 has opposite front and rear surface 33, 34, and a top surface 31. The mounting block 30 is formed with an insert hole 32 extending from the front surface 33 to the rear surface 34, and a threaded hole 311 that is formed in the top surface 31, that is in spatial communication with the insert hole 32, and that is aligned with the corresponding through hole 23 in the housing 20. The insert hole 32 permits extension of the contacting end portion 42 of the contacting member 40 thereinto such that the bent distal end 421 of the contacting end portion 42 of the contacting member 40 is disposed outwardly of the mounting block 30, as shown in FIG. 4.

Figure 5:
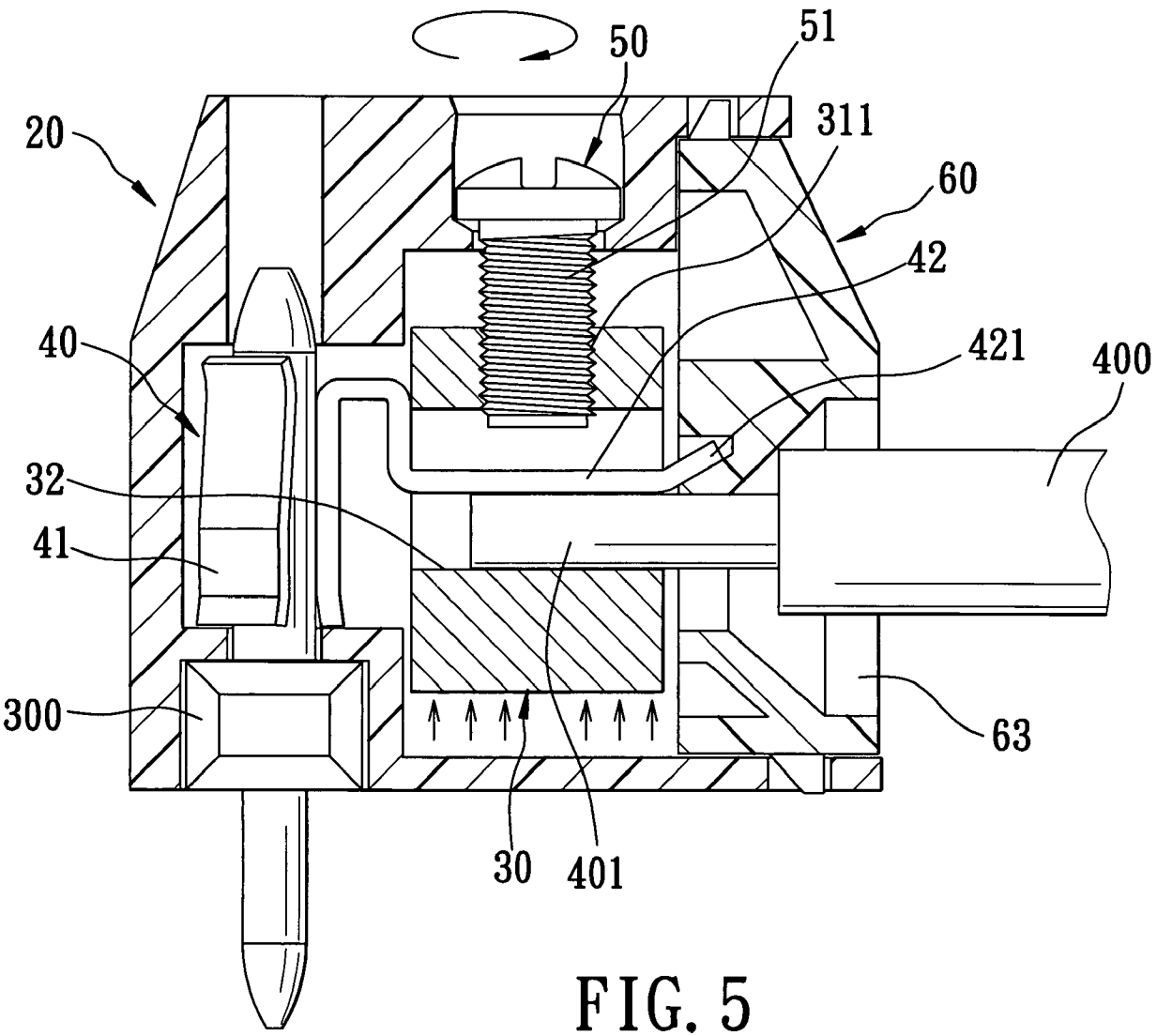
FIG. 5 is a schematic sectional view showing the first preferred embodiment when a fastening member is operable so as to drive a mounting block to move to a clamping position.

The cover body 60 is mounted on the front open side 24 of the housing 20 such that the conducting member 40 and the mounting block 30 are concealed within the corresponding receiving space 22 in the housing 20. The cover body 60 is formed with a plurality of insert grooves 63, each of which is adapted to permit an electrical wire 400 to be inserted into a corresponding one of the receiving spaces 22 threthrough, as shown in FIG. 5. In this embodiment, each of the top and bottom walls 28, 29 of the housing 20 is formed with a front engaging extension 281, 291 that is formed with a plurality of engaging holes 282, 292. The cover body 60 is formed with a plurality of engaging blocks 61, which engage the engaging holes 282, 292 in the top and bottom walls 28, 29 of the housing 20, respectively, such that the cover body 60 is secured between the front engaging extensions 281, 291 of the top and bottom walls 28, 29, as shown in FIG. 4. Furthermore, the cover body 60 has a mounting surface 62 that faces the front open side 24 of the housing 20 and that is formed with a plurality of engaging grooves 621. The corresponding engaging groove 621 engages the bent distal end 421 of the contacting end portion 42 of the contacting member 40 so as to prevent movement of the contacting end portion 42 of the conducting member 4 in the corresponding receiving space 22 in the housing 20, as shown in FIG. 4.

The fastening member 50 is mounted rotatably in the corresponding through hole 23 in the housing 20, and extends into the corresponding receiving space 22 in the housing 20. The fastening member 50 has a thread rod portion 51 that engages the threaded hole 311 in the mounting block 30. The fastening member 50 is operable so as to drive the respective mounting block 30 to move upwardly within the housing 20, thereby pressing an exposed end portion 401 of the electrical wire 400 against the contacting end portion 42 of the contacting member 4, as shown in FIG. 5.

Figure 6:
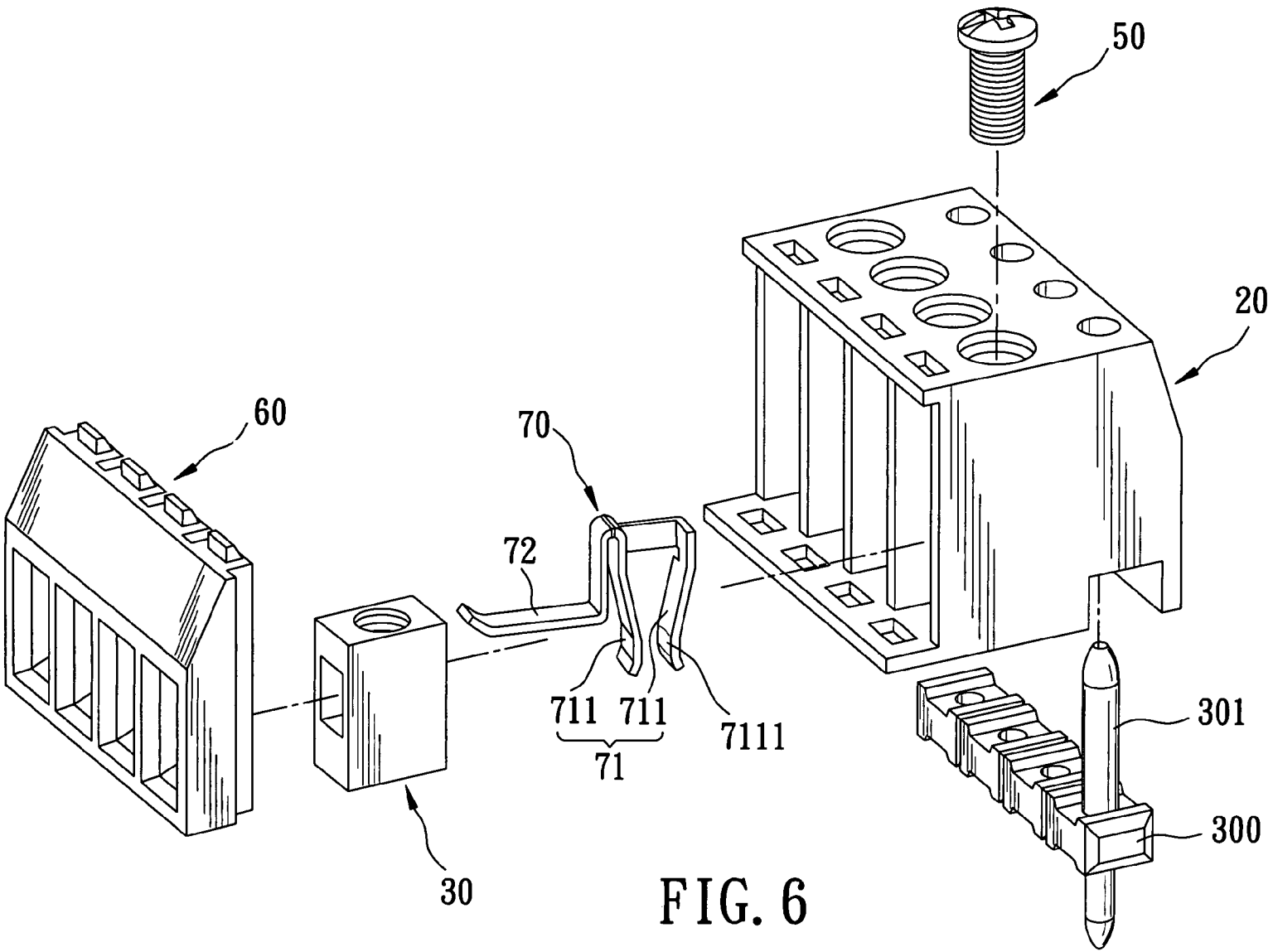
FIG. 6 is an exploded perspective view showing the second preferred embodiment of a terminal-mounting seat according to the present invention.

FIG. 6 illustrates the second preferred embodiment of a terminal-mounting seat according to this invention, which is a modification of the first preferred embodiment. Unlike the previous embodiment, the clamping unit of the terminal-engaging end portion 71 of the contacting member 7 includes two curved clamping arms 711. Each curved clamping arm 711 has a curved facet 7111 facing that of the other curved clamping arm 711 and is adapted to be in electrical contact with the terminal 301 of the terminal set 300.

The following are some of the advantages attributed to the terminal-mounting seat of the present invention:

1. Since the exposed end portion 401 of the electrical wire 400 can be evenly clamped between the mounting block 30 and the contacting end portion 42, 72 of the contacting member 40, 70 by operation of the fastening member 50, deformation of the contacting member 40, 70 can be prevented, and the exposed end portion 401 of the electrical wire 400 may remain undamaged, thereby ensuring good electrical contact between the contacting member 40, 70 and the electrical wire 400.

2. Due to the presence of the cover body 60, the conducting member 40, 70 is shielded such that the damage of electrical shock as a result of contact to the contacting member 40 by a user is avoided.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A terminal-mounting seat comprising:

a housing configured with a receiving space and having a front open side and a rear side, said housing further having opposite top and bottom walls, said top wall being formed with a through hole in spatial communication with said receiving space, said bottom wall being formed with a mounting hole that is in spatial communication with said receiving space and that is adapted to permit extension of a terminal therethrough;

a conducting member mounted fixedly in said receiving space in said housing, said conducting member having an terminal-engaging end portion disposed adjacent to said rear side of said housing and adapted to be in electrical contact with the terminal, and an elongate contacting end portion connected to said terminal-engaging end portion and disposed adjacent to said front open side of said housing;

a mounting block mounted movably in said receiving space in said housing, said mounting block having opposite front and rear surfaces, and a top surface, said mounting block being formed with an insert hole extending from said front surface to said rear surface, and a threaded hole that is formed in said top surface, that is in spatial communication with said insert hole, and that is aligned with said throughhole in said housing, said insert hole permitting extension of said contacting end portion thereinto;

a cover body mounted on said front open side of said housing such that said conducting member and said mounting block are concealed within said receiving space in said housing, said cover body being formed with an insert groove adapted to permit an electrical wire to be inserted into said receiving space therethrough; and a fastening member mounted rotatably in said through hole in said housing and extending into said receiving space in said housing, said fastening member having a thread rod portion that engages said threaded hole in said mounting block, said fastening member being operable so as to drive said mounting block to move upwardly within said housing, thereby pressing the electrical wire against said contacting end portion of said conducting member.

2. The terminal-mounting seat as claimed in claim 1, wherein each of said top and bottom walls of said housing is formed with a front engaging extension, said cover body being engaged between said front engaging extensions of said top and bottom walls.

3. The terminal-mounting seat as claimed in claim 1, wherein said contacting end portion of said conducting member has a bent distal end disposed outwardly of said mounting block, said cover body having a mounting surface that faces said front open side of said housing and that is formed with an engaging groove which engages said bent distal end so as to prevent movement of said contacting end portion of said conducting member in said receiving space in said housing.

4. The terminal-mounting seat as claimed in claim 1, wherein said terminal-engaging end portion of said conducting member is formed with a clamping unit adapted to clamp the terminal.

5. The terminal-mounting seat as claimed in claim 4, wherein said clamping unit includes three clamping arms.

6. The terminal-mounting seat as claimed in claim 4, wherein said clamping unit includes two curved clamping arms.

* * * * *